US005615595A

United States Patent [19]

Davis

[11] Patent Number: 5,615,595

[45] Date of Patent: Apr. 1, 1997

[54] TANDEM CYLINDER CONTROL

[75] Inventor: Albert S. Davis, Richmond, Tex.

[73] Assignee: Bettis Corporation, Waller, Tex.

[21] Appl. No.: 488,800

[22] Filed: Jun. 30, 1995

[51] Int. Cl.[6] ..... F15B 11/024

[52] U.S. Cl. ..... 91/440; 91/450

[58] Field of Search ..... 91/440, 450, 520

[56] References Cited

U.S. PATENT DOCUMENTS 3,853,037 12/1974 Denzler et al. ..... 91/440

*Primary Examiner*—F. Daniel Lopez

*Attorney, Agent, or Firm*—Robert W. B. Dickerson

[57] ABSTRACT

Tandem arranged cylinders having a common wall therebetween, with a common piston rod extending through said common wall, said rod carrying a piston for reciprocation within each said cylinder, and a valve member for fluid communication between said cylinders, permitting pressure equalization therebetween.

1 Claim, 2 Drawing Sheets

TANDEM CYLINDER CONTROL

BACKGROUND OF THE DISCLOSURE

Pneumatic or hydraulic cylinders have long been used to power or operate numerous types of machinery, including valve actuators. Thrust is generated by virtue of pressure applied against a piston. One means to increase such thrust is to increase the piston size. Such increase in piston size is limited by such parameters as the capabilities of the machine tools and materials used to fabricate the pistons. When the practical limits of such parameters have been reached, multiple cylinders, in tandem arrangement, including a common piston rod, were developed for use. The pressure boundaries of such tandem arrangement of cylinders are the end caps of each cylinder as well as the common wall or end cap dividing adjacent cylinders. Such intermediate cap or wall is generally thin, as a result of design pressure and material strength. As a result, it provided insufficient thickness, on its outer diameter, to install a pressure port adequate for tandem cylinder devices used in many high speed applications. It was to eliminate this increased thickness of the common wall, as well as the accompanying increased length and external piping required, as well as to reduce the size of the external valving and piping, that this invention was directed.

SUMMARY OF THE INVENTION

Linearly arranged, tandem cylinders, are joined by a common end cap or wall. A common piston rod reciprocates through an opening in said common wall, and carries opposed pistons, one for oscillation in each said cylinder. Appropriate piping provides pressurized fluid from a supply source to like positioned faces of each piston. Valve means is provided, preferably within said common wall, permitting fluid exhaust from one cylinder to the other, whereby quick pressure equalization occurs between adjacent areas of the tandem arranged cylinders.

DESCRIPTION OF THE INVENTION

Figure 1:
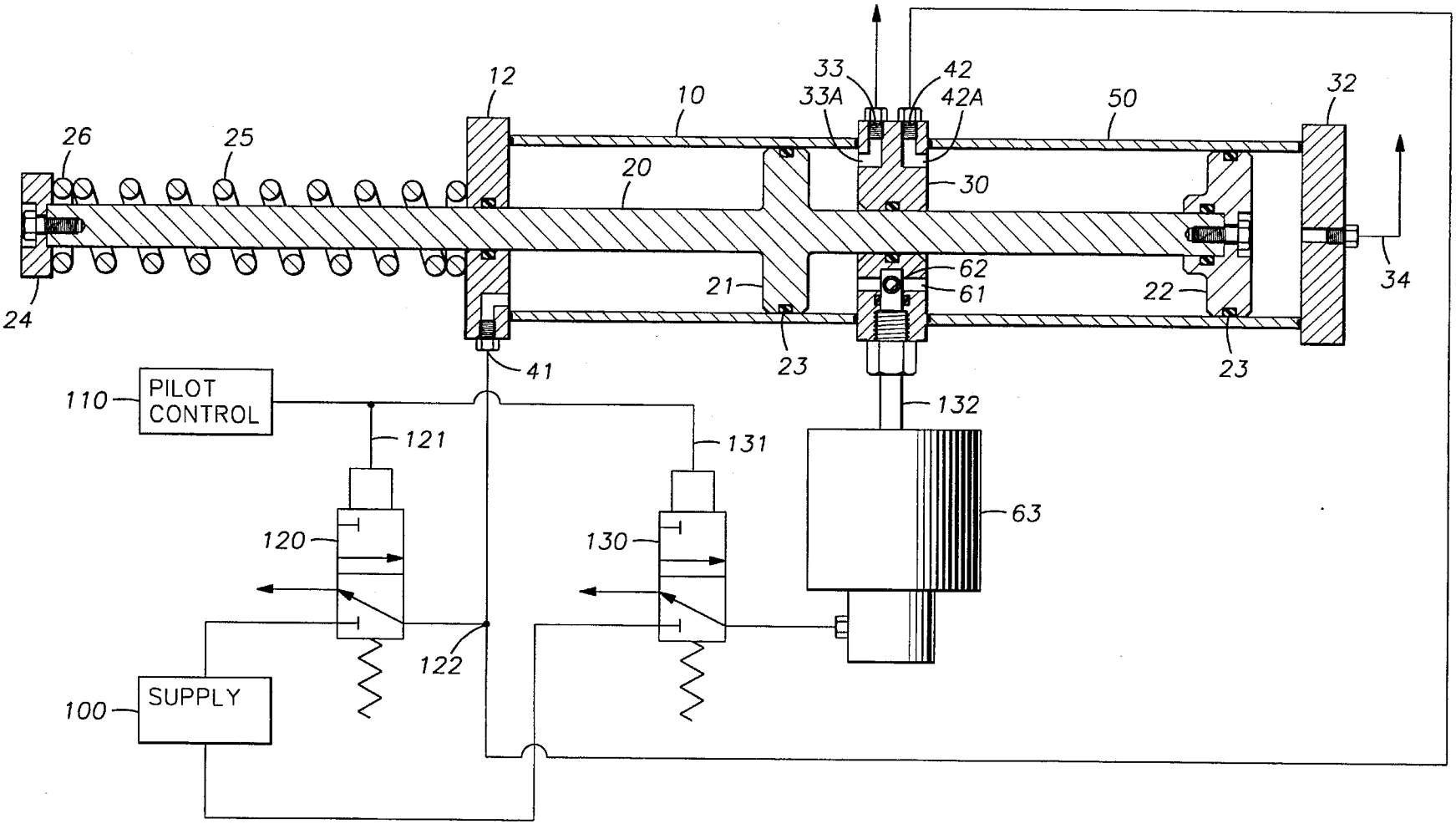
FIG. 1 is a partly schematic vertical section of the tandem cylinder arrangement, and controls therefor, of this invention.

A pair of cylinders 10 and 50 are linked end to end via a common end cap or wall 30. Each cylinder is releasably joined, at one of its ends, to said common end cap, by some convenient means (not shown), such as guide rods or other threaded fastener. The other end of each cylinder would be closed by its respective end cap 12 or 32.

Slidably and sealingly received by common end cap 30 and by end cap 12 of cylinder 10, it a common piston rod 20. Secured to and carried by said piston rod are pistons 21, 22 for reciprocation within each piston's respective cylinder cavities "A" and "B". Said pistons carry annular seals 23, for sealing engagement with the inner wall of the two cylinders. Piston 22 is secured to one end of rod 20, while piston 21 is secured to said rod intermediate its ends. Said piston rod also carries spring guide 24 for seating one end 26 of coil spring 25. Said spring is provided for biasing pistons 21 and 22 toward end cap 12 and common end cap 30, respectively, i.e., to the left in the drawings. Vents 33 and 34 are provided to vent cylinders A and B from the space intermediate pistons 21, 22 and the common end cad 30 and end cap 32, respectively. Vent passageway 33-A extends through common end cap 30.

Supply pressure inlets 41, 42 are provided respectively to end cap 12 and common end cap 30, respectively to pressurize cavities "A" and "B", urging pistons 21 and 22 in the direction of common end cap 30 and end cap 32, respectively. Pressure passageway 42A extends through common end cap 30.

Equalizing pressure passageway 61 communicates between cavities "A" and "B". Positioned therein is valve assembly 62, which may be, for example, of the butterfly or ball type. The operation of such valve assembly is governed by control 63, which may be a rack and pinion or spring return type actuator made by Bettis Corporation, which, in turn is activated by supply pressure.

Figure 2:
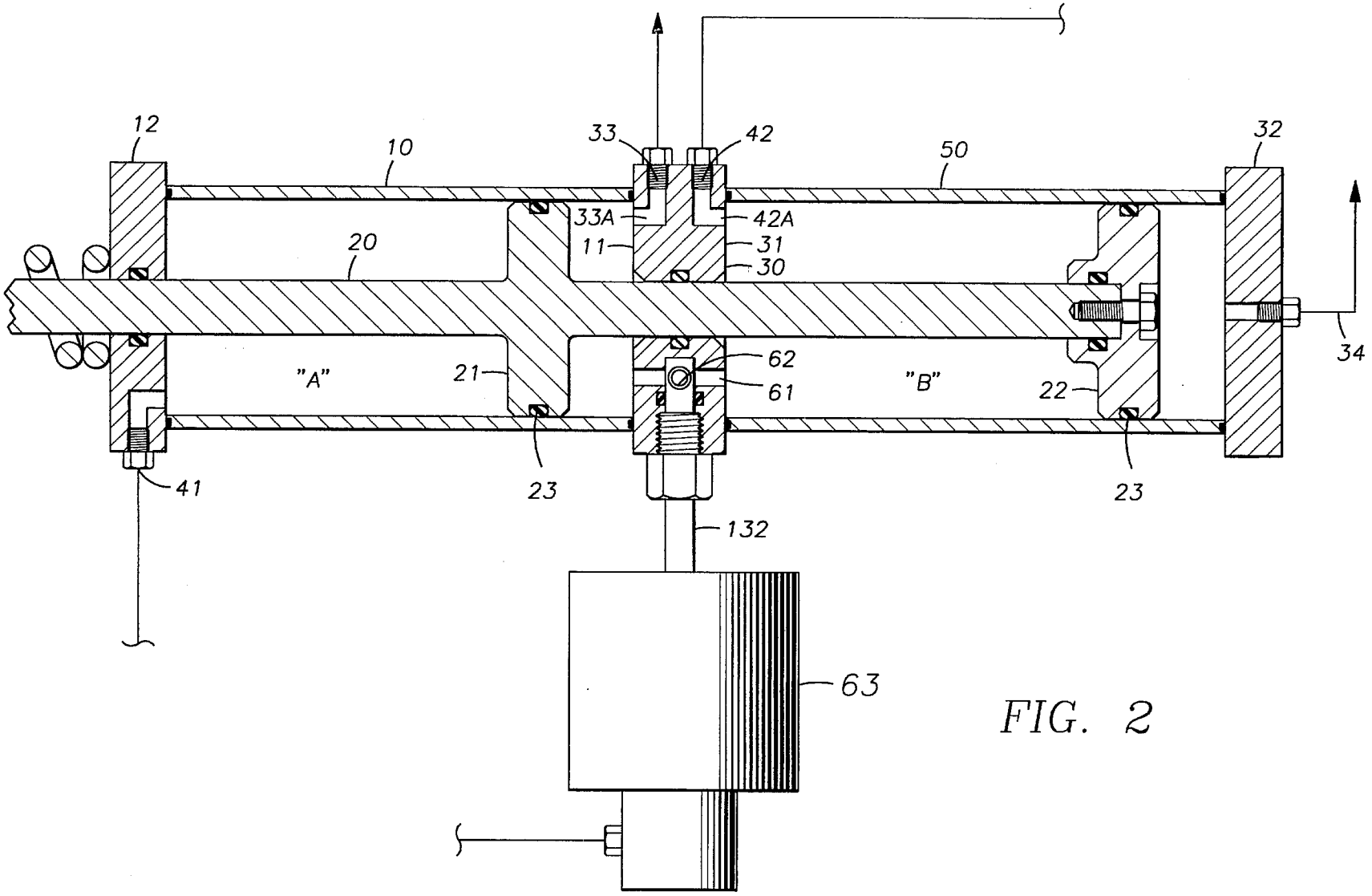
FIG. 2 is an enlarged detail of the tandem cylinders and quick release valve.

Consider the structure and operation of the external piping of the invention. A source of supply or operating fluid (hydraulic or pneumatic) under pressure is illustrated schematically at 100, while a similar source of pilot control fluid is shown at 110. Such pilot fluid regulates the position of both 3-way valves 120 and 130, and thereby the flow of supply fluid to cylinders 10, 50 as well as to equalizer valve control 63. On pilot control fluid being caused to flow through lines 121, 131, valves 120, 130 are moved to their open position whereby supply fluid would pass through the valves to control 63 and to junction 122 from where the supply fluid would flow into cylinder 10 through inlet 41 as well as into cylinder 50 through inlet 42. The supply fluid would exert force against the left-hand faces of pistons 21 and 22, urging them to the right in FIGS. 1 and 2, against the force of spring 25. The reciprocating, linear motion of piston rod 20 would likely be used to translate linear motion into rotary motion. For example, a transverse pin (not shown) may be carried by rod 20, or an extension thereof. Such pin may ride in the slots possessed by the spaced arms of a scotch yoke valve actuator, such as those manufactured by Bettis Corporation.

Equalizer valve control 63, through control apparatus such as actuator arm 132, on receiving supply fluid, would close equalizer valve 62, preferably by causing counter clockwise rotation of actuator arm 132. In the absence of supply pressure, said equalizer valve would remain open, thereby equalizing pressure on opposite sides of common end cap or wall 30.

After movement of pistons 21 and 22 in the direction of the arrows to their right-hand position, on a signal reaching pilot control 110, pilot fluid ceases to be provided to valves 120, 130, shifting their spools to the exhaust position. Such shifting of valve 130 results in equalizer valve control 63 opening equalizer valve 62. On this occurring, almost immediately, pressure on opposite sides of wall or cap 30 is equalized. This allows pressure to be vented through a smaller size vent 33 than would otherwise be possible. Spring 25 would return the piston rod 20, to its left-hand position. On pilot pressure again being available, the next cycle would begin.

Although only a single embodiment has been described, it should be obvious that numerous modifications would be possible by one skilled in the art without departing from the spirit of the inventions the scope of which is limited only by the following claims.

I claim:

1. A fluid operated control device comprising:

housing member, said housing including;

a pair of side by side, cavity-containing, cylinders, said cylinders' cavities each being terminated by a separate end cap and by a common wall, at least one of said end caps as well as said common wall each including a passageway therethrough for slidably and reciprocatingly receiving piston rod means, said piston rod means having secured thereto a separate piston sealingly and reciprocatingly engaged with the wall of each of said cylinders;

fluid passageway means through said common wall and being in fluid communication with each cavity adjacent to said common wall;

means for equalizing the fluid pressure in the portions of said cavities adjacent said common wall, said equalizing means comprising valve control means for opening and closing said common wall's passageway means;

spring return means for biasing said piston rod means toward a second position; and fluid supply means for urging said piston rod means toward a first position.

* * * * *